United States Patent [19]

Raymor et al.

[11] Patent Number: 4,521,255

[45] Date of Patent: Jun. 4, 1985

[54] METHOD FOR WASHING A FIBROUS MAT

[76] Inventors: Willard E. Raymor, 547 NW. Pacific Ave., Chehalis, Wash. 98532; Peter L. Hedegard, 16800 NE. 31st St., Bellevue, Wash. 98001

[21] Appl. No.: 517,252

[22] Filed: Jul. 25, 1983

[51] Int. Cl.[3] ..... B08B 3/02

[52] U.S. Cl. ..... 134/33; 134/138

[58] Field of Search ..... 134/33, 138, 139; 68/205 R

[56] References Cited

U.S. PATENT DOCUMENTS

| | | | |
|---|---|---|---|
| 3,075,534 | 1/1963 | Habostad | 134/138 |
| 3,120,236 | 2/1964 | Ball | 134/138 X |
| 3,345,075 | 10/1967 | Phillipson et al. | 134/138 X |
| 3,886,960 | 6/1975 | Krueger | 134/138 |
| 4,061,153 | 12/1977 | Doherty | 134/138 |

*Primary Examiner*—Marc L. Caroff

*Attorney, Agent, or Firm*—Thomas W. Secrest

[57] ABSTRACT

A coplanar fibrous mat is cleaned by directing an aqueous medium into contact with two opposed surfaces of the mat while the mat is positioned on a support to rotate the mat at a sufficient speed to cause particles to leave the mat due to centrifugal force.

7 Claims, 25 Drawing Figures

METHOD FOR WASHING A FIBROUS MAT

THE BACKGROUND OF THE INVENTION

In many cleaning operations and also in finishing operations for a floor or a similar surface there is used a member. The member is used for cleaning purposes and is used for finishing purposes for buffing the floor. Also, the member can be used for removing particles from the floor to present a new surface. For example, with tile it may be desirable to remove the exposed thin layer of the tile to have fresh tile exposed for buffing and also for waxing. In other instances it may be desirable to clean the tile or the floor with a cleaning solution prior to waxing and buffing the floor. The tile can be terrazzo tile or can be ceramic tile.

Such a member can be a pad or a mat for cleaning purposes, abrading purposes, buffing and polishing purposes. With the member moving and rotating the particles of the floor or surface being worked move into the member and harm the effect of the member for cleaning, abrading, polishing and buffing purposes. For example, with a fibrous mat, the fibrous mat becomes a repository for the particles of dirt, wax, plastic and the like. The particles become enmeshed in the interstices of the pad or mat and coat parts or all of the pad or mat. The result is that the effectiveness of the pad or mat is lessened or may be destroyed.

The pad or mat may be circular, oblong, eliptical, square or rectangular in configuration. Also, the pad or mat need not be a fibrous mat but can be a plastic mat, a polishing mat, an abrasive mat or a cork mat to name a few other suitable pads or mats.

With the interstices of the pad or mat filled with particles, the pad or mat does not function effectively. In many instances, it is necessary to clean the pad or mat so that it can function effectively. Prior to this invention the cost of cleaning low cost pads or mats such as a fibrous mat has been relatively high compared to the cost of a new fibrous mat. Also, the mat in many instances was not sufficiently cleaned to justify the time and the expense of cleaning the mat. It is my understanding that some people would clean a pad or a mat by directing a stream of water from a hose, such as a garden hose, onto the mat. Generally, this process was time consuming and did not adequately clean the pad or the mat. Therefore, instead of taking the effort and the time to clean the soiled fibrous mat, the soiled fibrous mat had been discarded or thrown away and a new mat installed and used. With this invention I have devised an apparatus and method making it possible to clean a pad or a mat and free the pad or mat from particles enmeshed in the interstices of the pad or mat.

THE GENERAL DESCRIPTION OF THE INVENTION

The invention comprises a housing having a central cavity. There is provided a cover for the housing.

The housing receives the member such as a pad or mat which is to be worked. There is a means in the housing to move and to rotate the pad or member. Also, there is a means to direct a fluid towards said pad or mat to remove said particles from the pad or mat.

The pad or mat, to repeat, can be circular or oblong, or elliptical or square or rectangular. It is possible to rotate such a pad or mat of an irregular shape at the slow revolution and to direct the fluid toward the rotating pad or mat. The fluid may be hot water or may be a cleaning fluid for removing the particles from the pad or mat. Further, to assist in removing the particles the pad or mat may be subjected to a precleaning action such as by soaking for a few hours in a cleaning solution. In the cleaning of the mat some of the particles fly off of the rotating mat because of centrifugal action.

THE DRAWINGS

In the drawings it is seen that FIG. 1 is a front elevational view of the washer and illustrates a passageway in the front panel;

Figure 9:
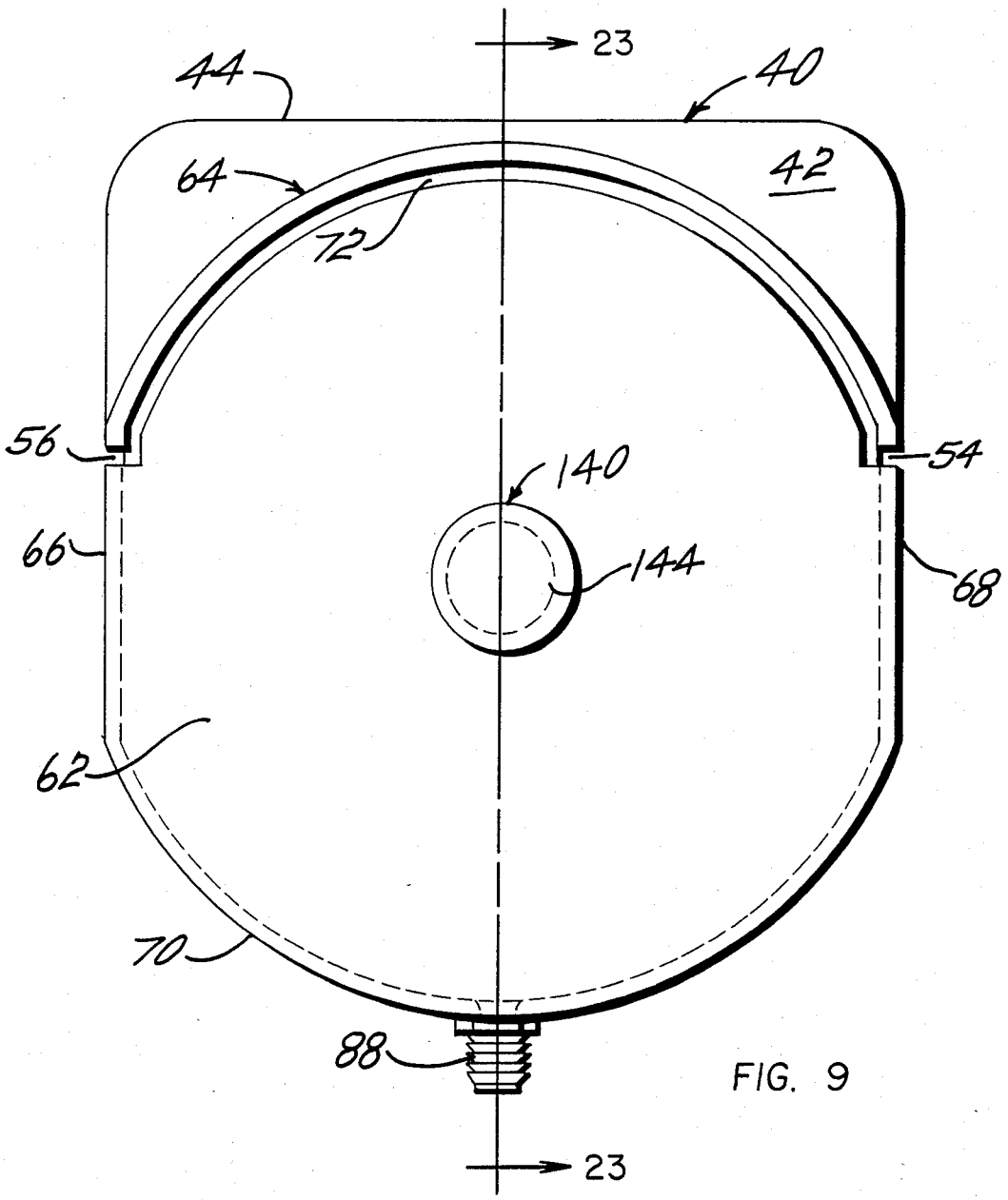
FIG. 9 is a front elevational view of the washer with the shaft in place and the passageway in the front panel.
Figure 10:
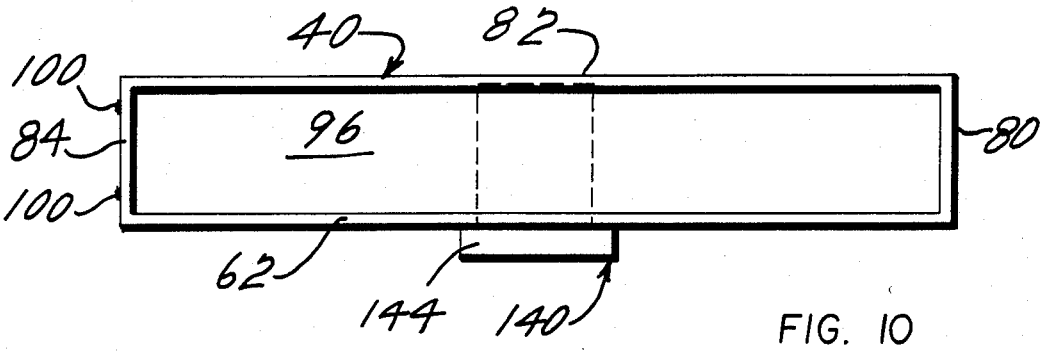
FIG. 10 is a top plan view of the washer with the shaft in place and also the cover in place.
Figure 12:
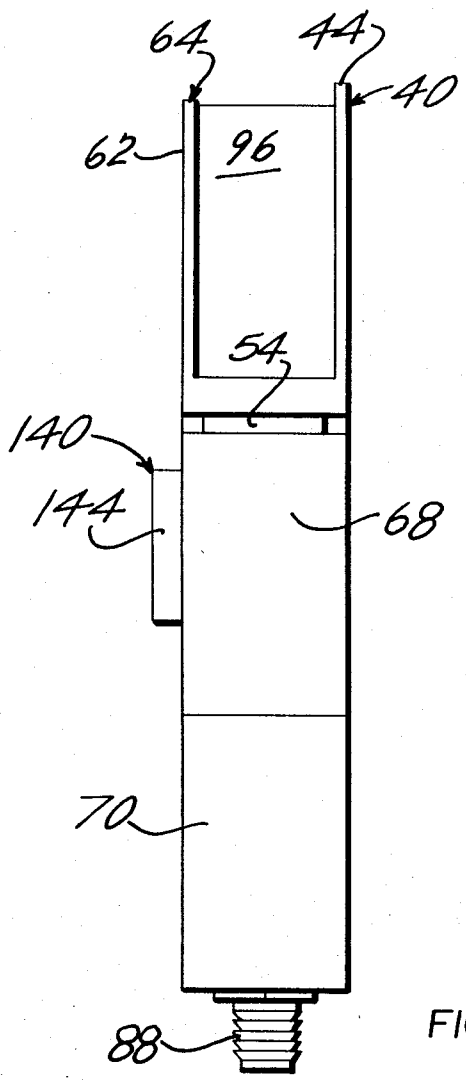
FIG. 12 is a right side elevational view of the washer and illustrates the shaft in position and also the cover in position.
Figure 11:
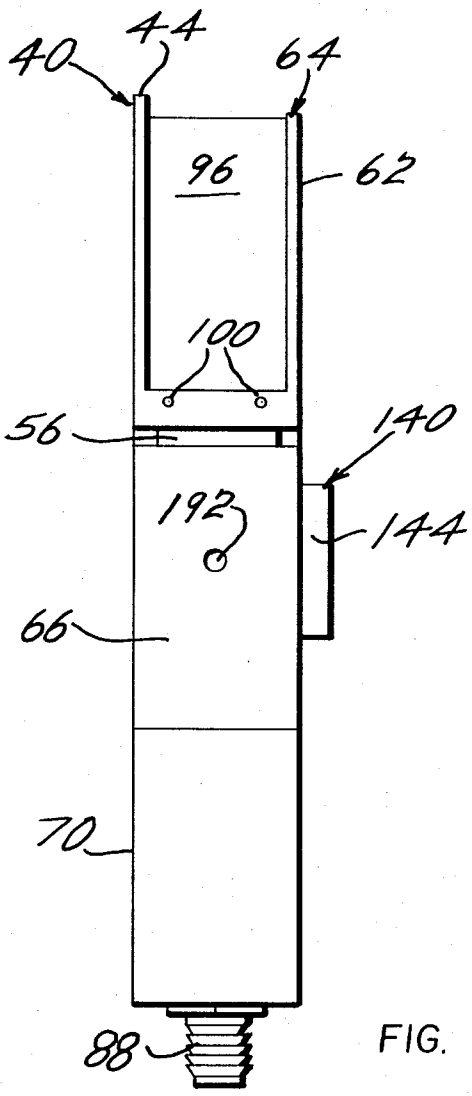
FIG. 11 is a left side elevational view of the washer and illustrates the shaft in position and also an opening in the left side and with the cover in position.
Figure 21:
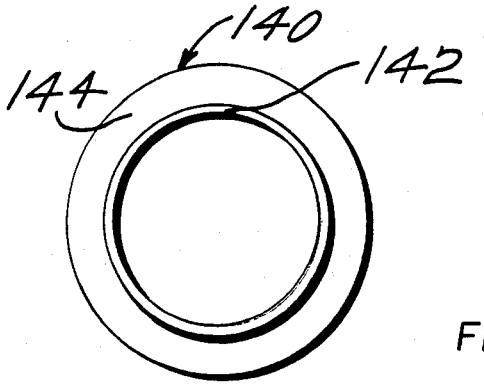
FIG. 21 is an inside view of the shaft.
Figure 22:
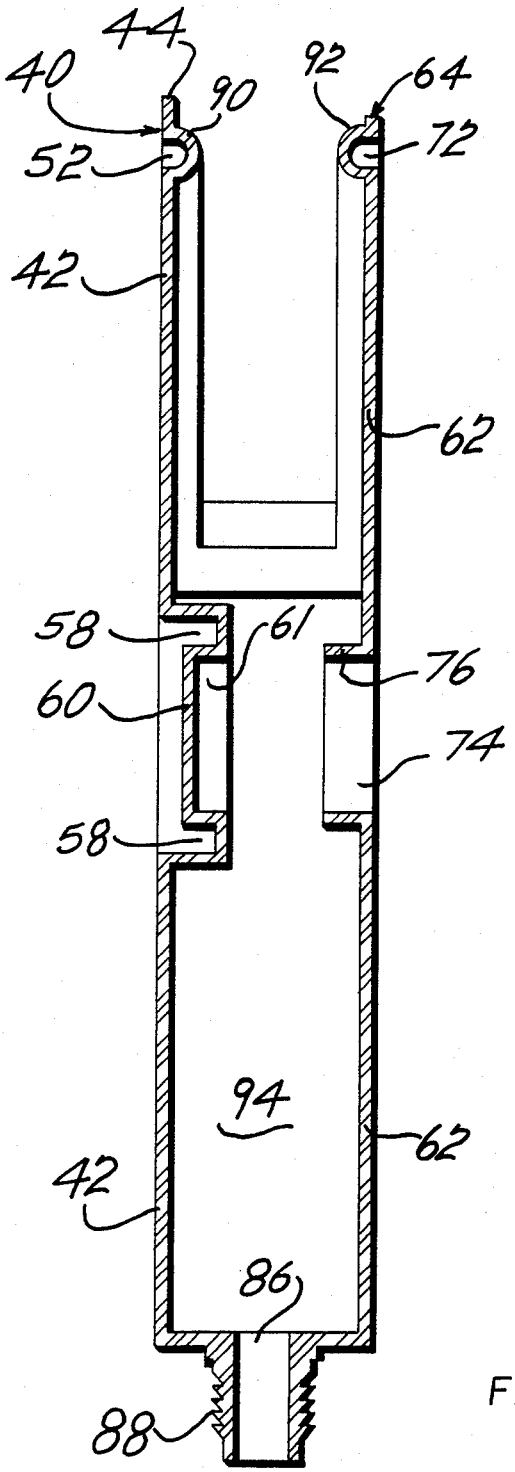
Figure 23:
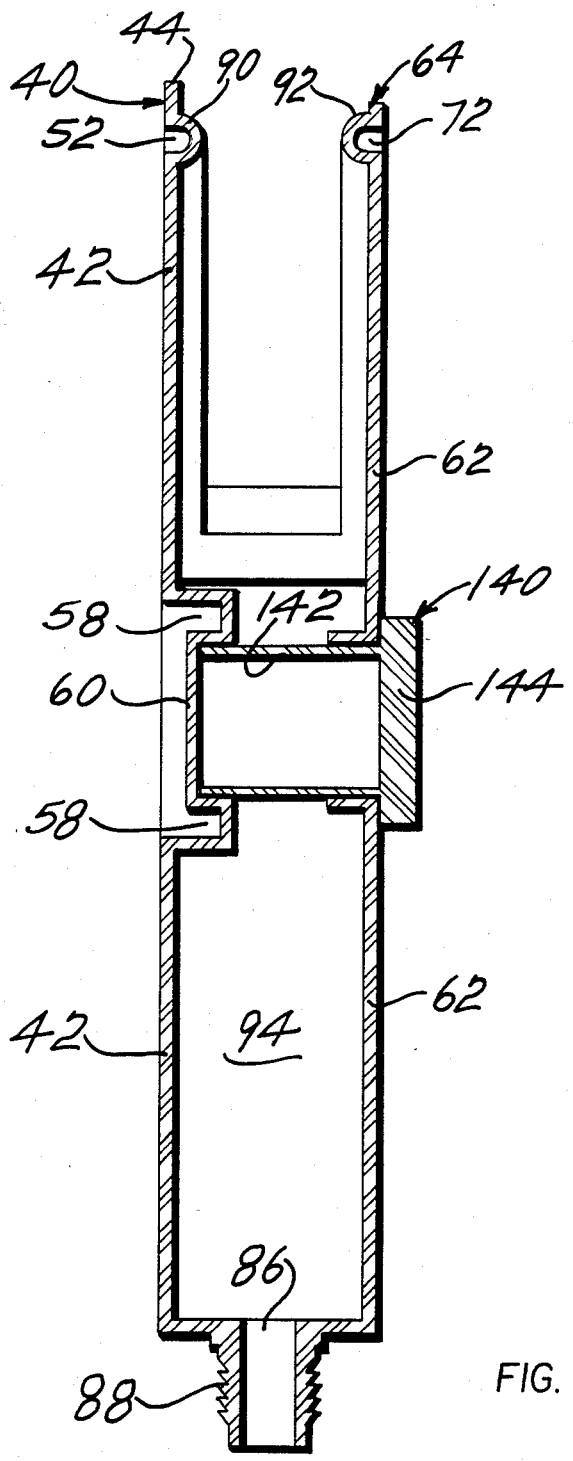
Figure 24:
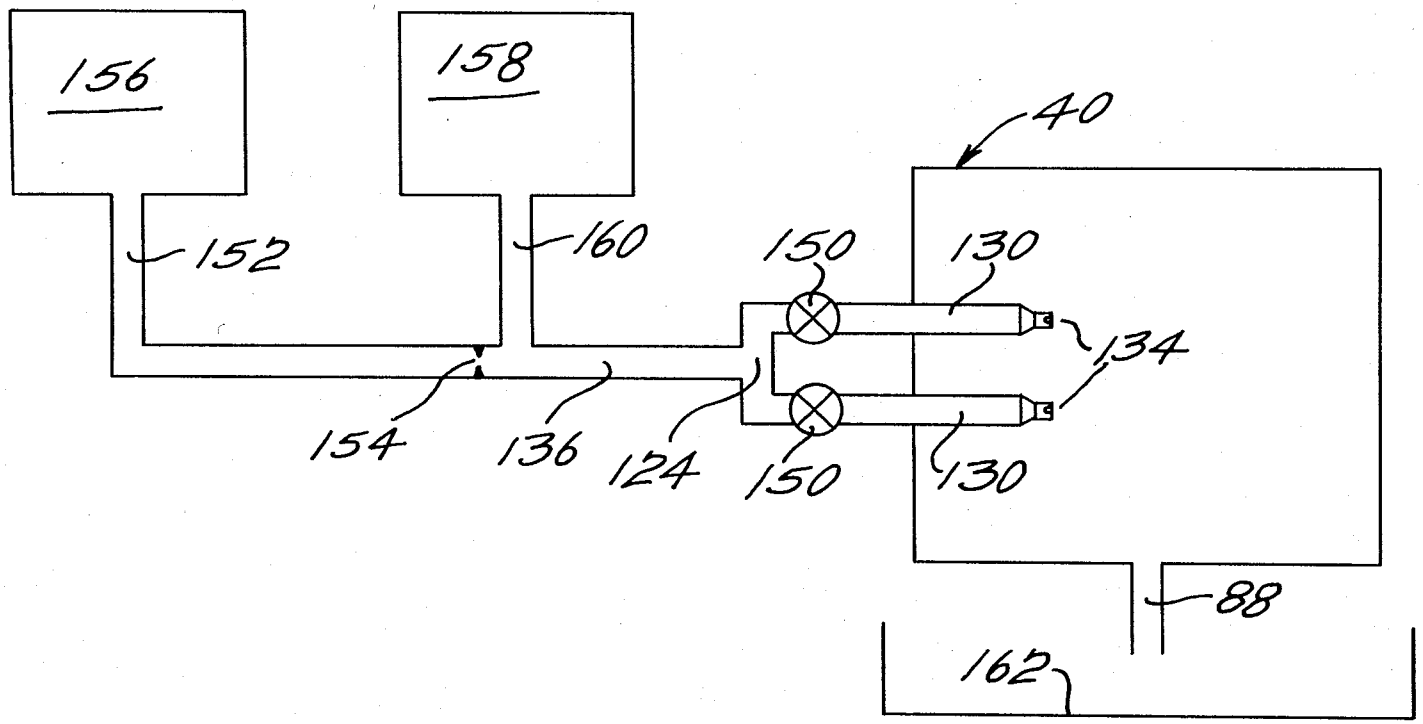
Figure 25:
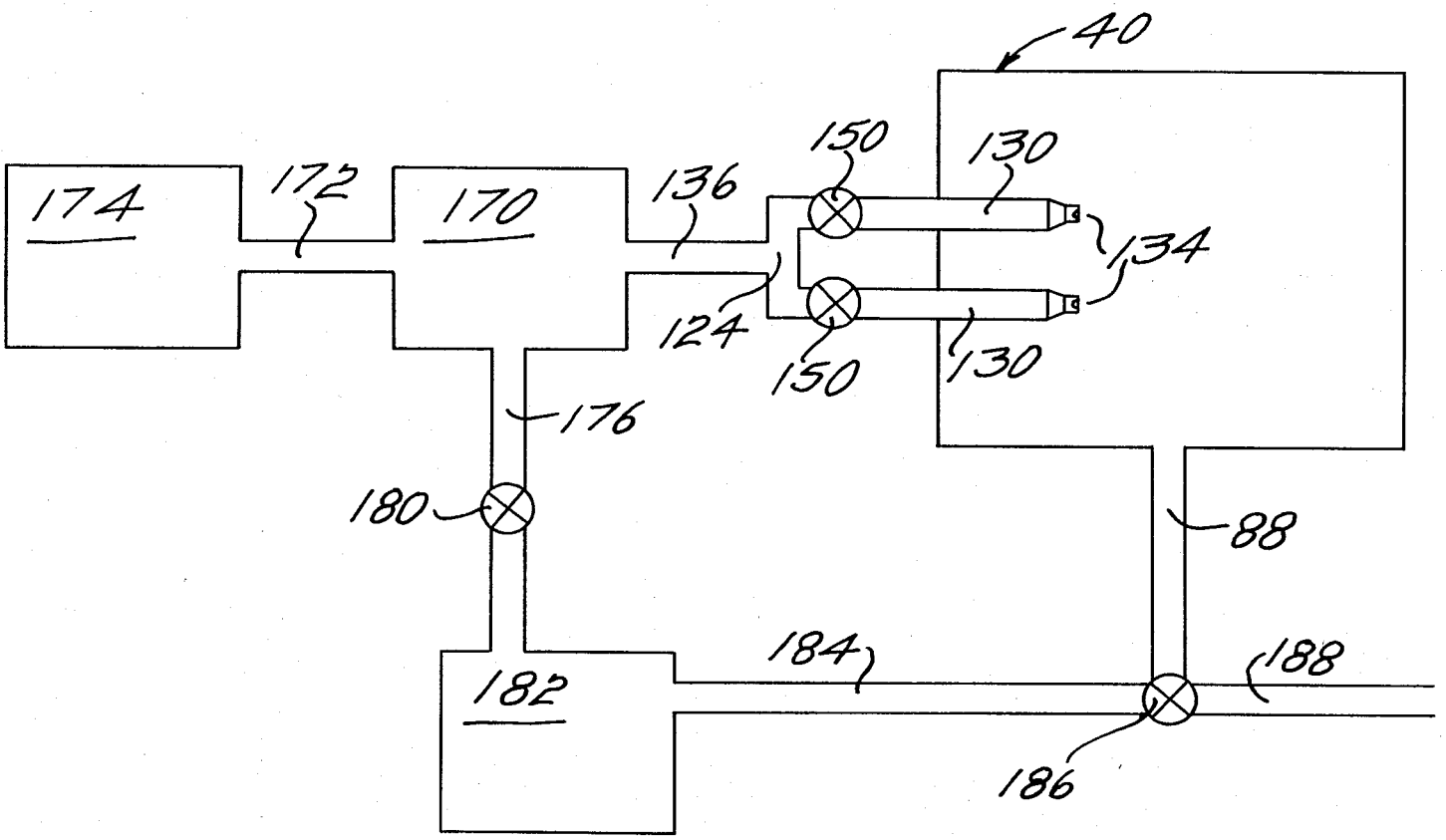

FIG. 22, taken on line 22—22 of FIG. 21, is a vertical cross-sectional view illustrating the washer with the rear panel and the recess for receiving a shaft, the outlet nozzle at the bottom of the washer, the front panel with the passageway for receiving a shaft, and the top of the washer for receiving the cover;

FIG. 23, taken on line 23—23 of FIG. 9, is a vertical cross-sectional view of the washer and illustrates the rear panel with the recess for receiving the shaft, the nozzle at the bottom of the washer, the front panel with a passageway for receiving the shaft, a shaft in the passageway and positioned in the recess in the rear panel and the top of the washer;

FIG. 24 is a schematic illustration of the washer, the nozzles for directing a liquid onto a mat in the washer, a source of water and a source of cleaning agents for mixing with the water; and, FIG. 25 is a schematic illustration of the washer, the nozzles for directing a liquid onto the mat or member, a source of liquid and a source of cleaning agents to mix with the liquid and a pump for recirculating the liquid from the washer after it has contacted the mat or member in the washer.

THE SPECIFIC DESCRIPTION OF THE INVENTION

In the drawings it is seen that there is a washer 40. The washer 40 comprises, essentially, a housing for a cavity.

The washer 40 comprises a back panel 42. The back panel 42 has a top edge 44, a left side 46, a right side 48 and a curved lower part 50. In the back panel it is seen that there is an inwardly directed arcuate recess 52. The lower part on the left starts near the left side 46 and curves upwardly and then downwardly to a low part near the right side 48.

At approximately the center of the left side 46 there is an indent 54. Also, at approximately the center of the right side 48 there is an indent 56.

In approximately the center of the back panel 42 there is a circular recess 58. The circular recess 58 surrounds a circular outside surface 60. In effect, the circular recess 58 defines a socket 61. The outside surface 60 and the circular recess define a socket or a bearing for receiving a shaft.

Figure 2:
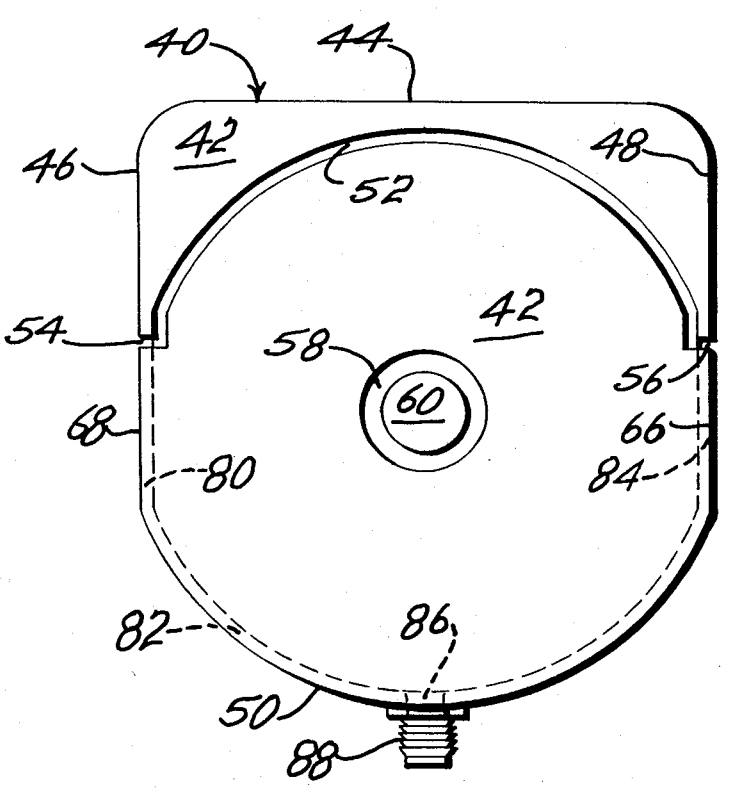
FIG. 2 is a rear elevational view of the washer and illustrates the recess for receiving a shaft.
Figure 1:
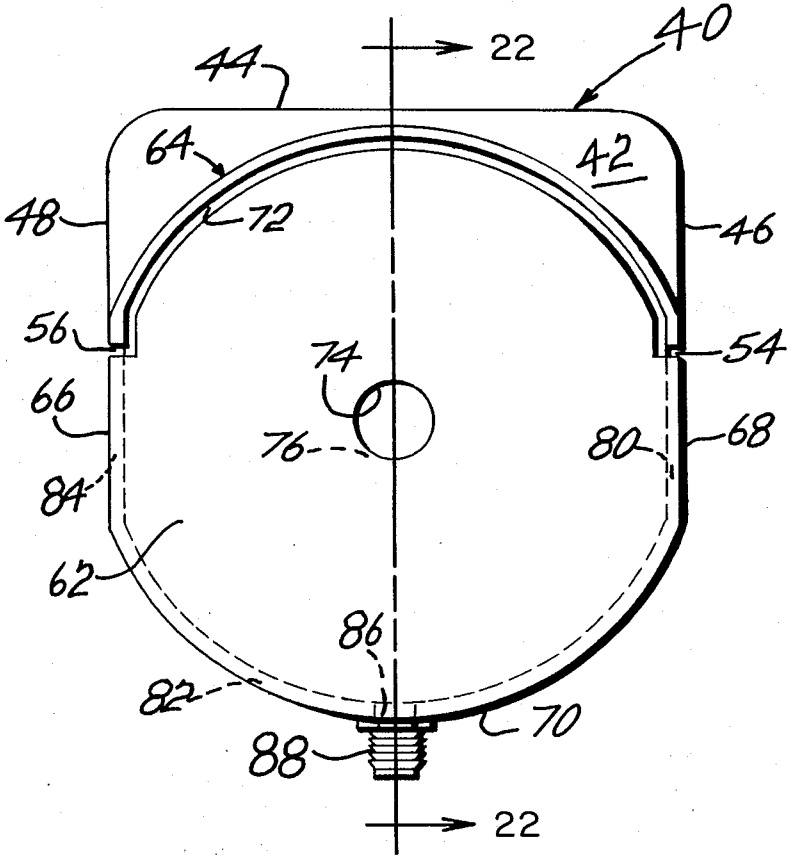

In FIG. 1 there is illustrated a front panel 62 having an upper arcuate shaped edge 64. There is a left side edge 66 and a right side edge 68. Also, there is a curved lower edge 70.

In the upper part of the front panel 62 and near the arcuate upper edge of 64 there is an inwardly directed arcuate recess 72. The recess 72 defines a shoulder. Also, the inwardly directed arcuate recess 52 in the back panel 42 defines a shoulder. The recesses 52 and 72 define shoulders for supporting a cover.

At approximately the center of the front panel 62 there is a passageway 74. Surrounding the passageway 74 and on the hidden surface of the back surface of the front panel 62 there is an inside circular rim 76.

There is between the front panel 62 and the back panel 42, as seen in FIG. 1, a right side 80, an arcuate bottom 82 and a left side 84. The side 80, arcuate bottom 82, and side 84 are continuous and unitary.

In the arcuate bottom 82 there is a passageway 86. A threaded nipple 88 connects with the arcuate bottom 82 and the passageway 86.

Figure 3:
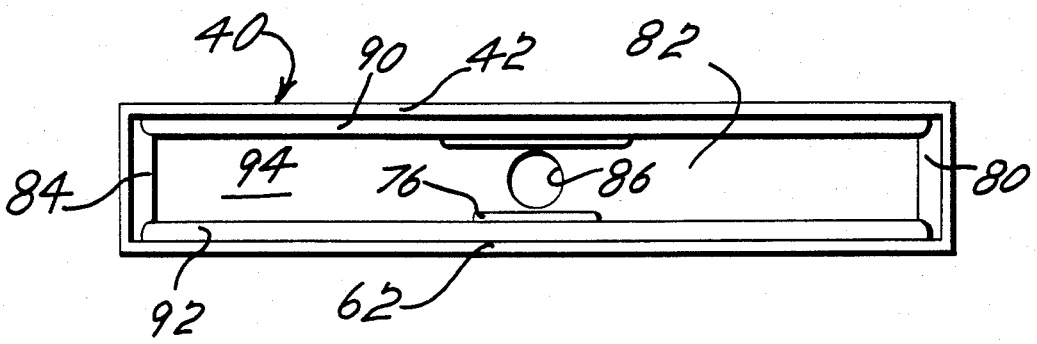
FIG. 3 is a top plan view of the washer.
Figure 4:
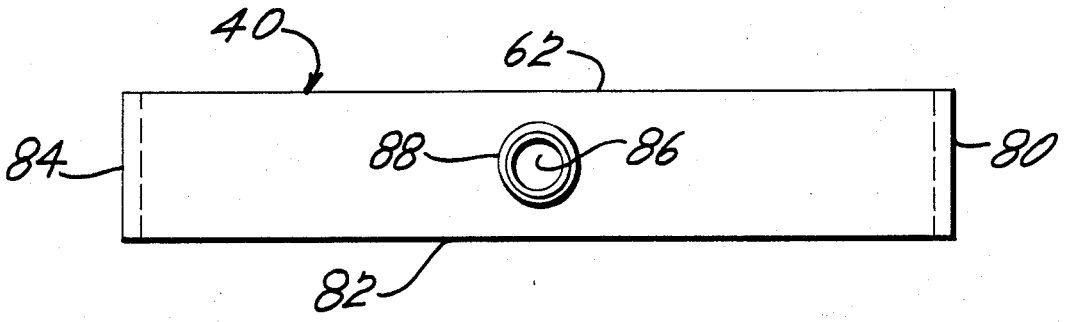
FIG. 4 is a bottom plan view of the washer.
Figure 6:
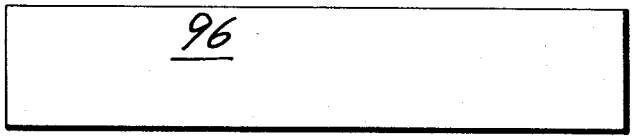
FIG. 6 is a top plan view of the cover.
Figure 8:
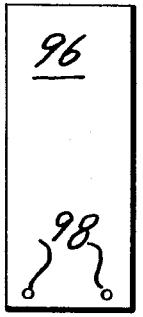
FIG. 8 is a side elevational view of the cover and illustrates tow passageways near the lower edge for receiving pins.
Figure 5:
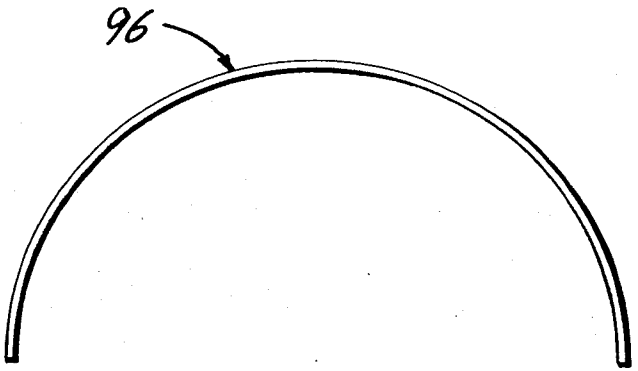
FIG. 5 is a side elevational view of the cover.
Figure 7:
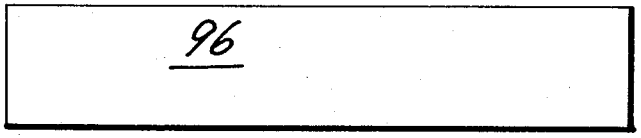
FIG. 7 is a bottom plan view of the cover.

The arcuate recess 52 in the back panel 42, as seen in FIG. 3, defines a shoulder or ledge 90.

The arcuate recess 72 in the front panel 62, as seen in FIG. 3, defines a shoulder 92.

The back panel 42, the front panel 62, the sides 80 and 84 and the arcuate bottom 82 define a housing having a cavity 94. With a liquid flowing into the cavity 94 there must be some means to prevent the liquid splashing out of the cavity 94. To prevent the liquid splashing out of the cavity 94 there is provided a cover 96 in the form of a strip of tough flexible plastic. The cover 96 lies over the cavity 94 and rests on the shoulders 90 and 92. The cover 96 has holes 98 near one end. Two pins or two screws 100 project through holes 98 and connect the cover 96 to the washer 40. A person using the washer 40 can lift the cover 96 so as to expose the cavity 94. This person can place the object to be washed in the cavity 94 and then the cover 96 can be placed over the cavity 94. With the cover 96 over the cavity 94 the liquid cannot splash out and be thrown out of the cavity 94.

Figure 14:
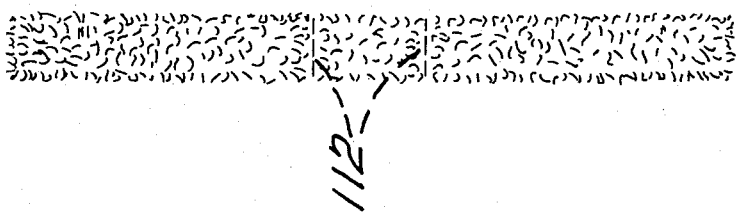
FIG. 14 is a side elevational view of the mat or member.
Figure 13:
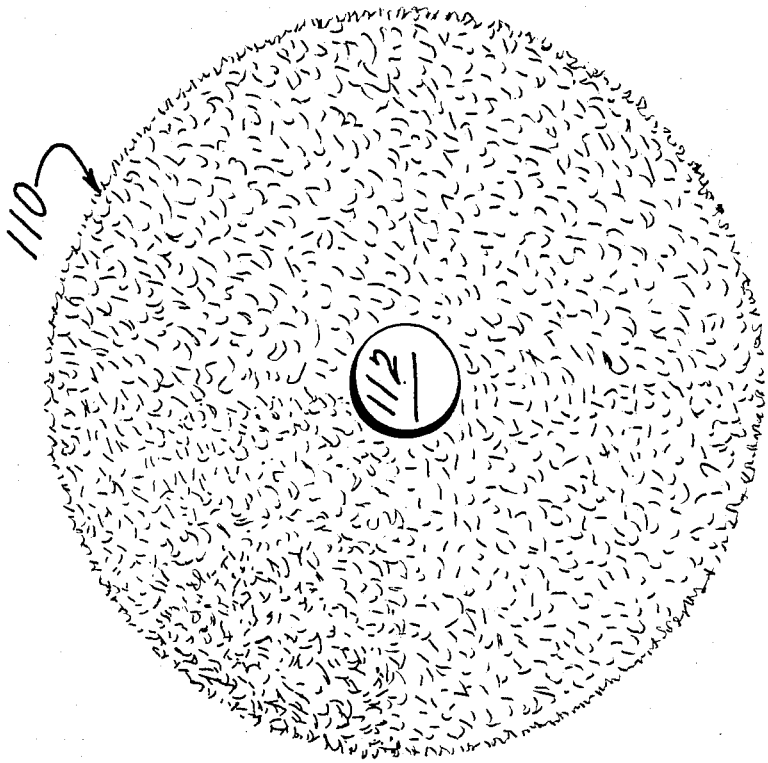
FIG. 13 is a front elevational view of a circular mat or a circular member and illustrates a central passageway.

In FIGS. 13 and 14 there is illustrated the circular mat 110 or a circular member 110 to be cleaned. It is seen that the circular mat 110 has a circular passageway 112.

Figure 15:
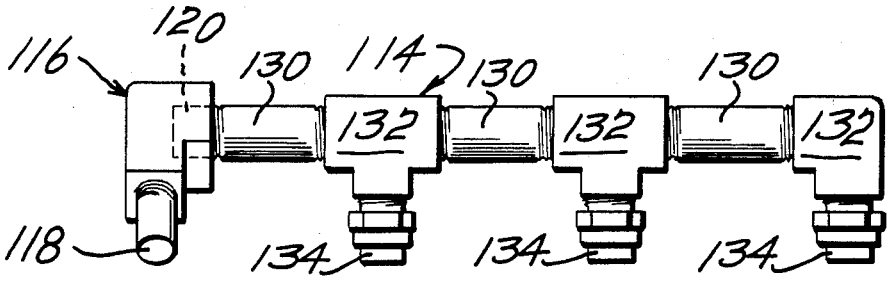
FIG. 15 is a side elevational view of the plumbing used in the washer and illustrates nozzles for directing liquid onto the mat or member.
Figure 16:
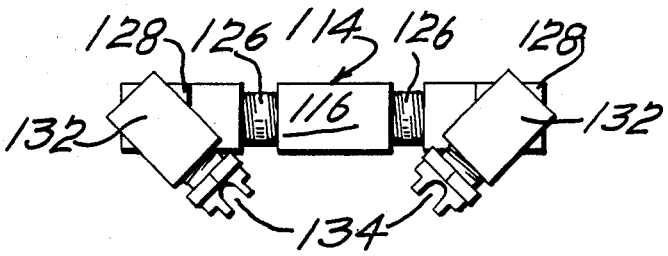
FIG. 16 is an end elevational view of the plumbing used in the washer and illustrates the nozzles for directing a liquid onto the mat or member.
Figure 17:
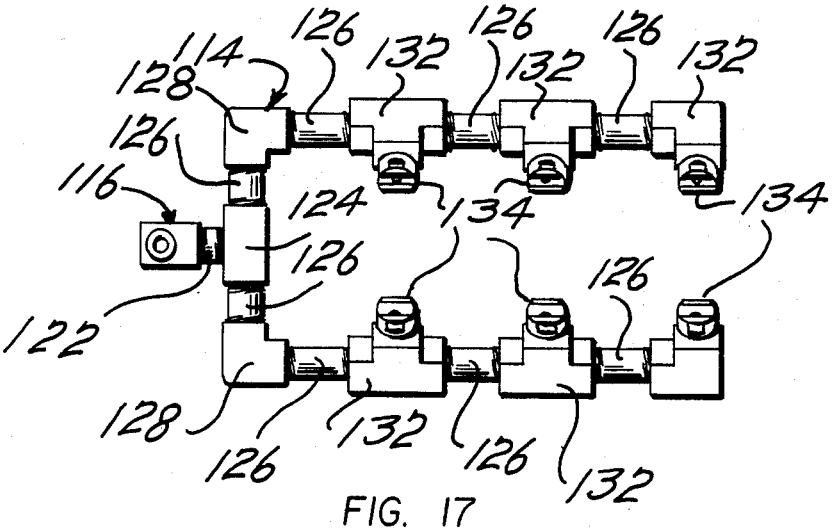
FIG. 17 is a bottom plan view of the plumbing used in the washer and illustrates the nozzles for directing a liquid onto the mat or member.

In FIGS. 15, 16 and 17 there is illustrated a plumbing system 114. The system 114 comprises a plumber's ELL 116 having an inlet pipe 118. There is a tapped outlet 120. A threaded pipe 122 is screwed into the tapped outlet 120 and also into a tapped opening in a TEE 124. The TEE 124 connects with two outlet pipers 126. Each of the pipes 126 connects with an ELL 128. The ELL 128 connects with a pipe 130 which in turn connects with a nozzle unit 132. The nozzle unit 132 has a downwardly and inwardly directed nozzle 134. There may be two or three or four, or more appropriate numbers, for the nozzle units 132 and nozzles 134. In FIGS. 15 and 17 there is illustrated two sets of three nozzles each. Again, the nozzles 134 are directed inwardly and downwardly so as to direct a fluid such as hot water toward the mat 110.

There is a shaft or arbor unit 140 comprising a right circular cylinder 142. The right circular cylinder 142 is hollow. On the outer part of the right circular cylinder 142 there is a circular plate 144 or a circular handle 144.

Figure 18:
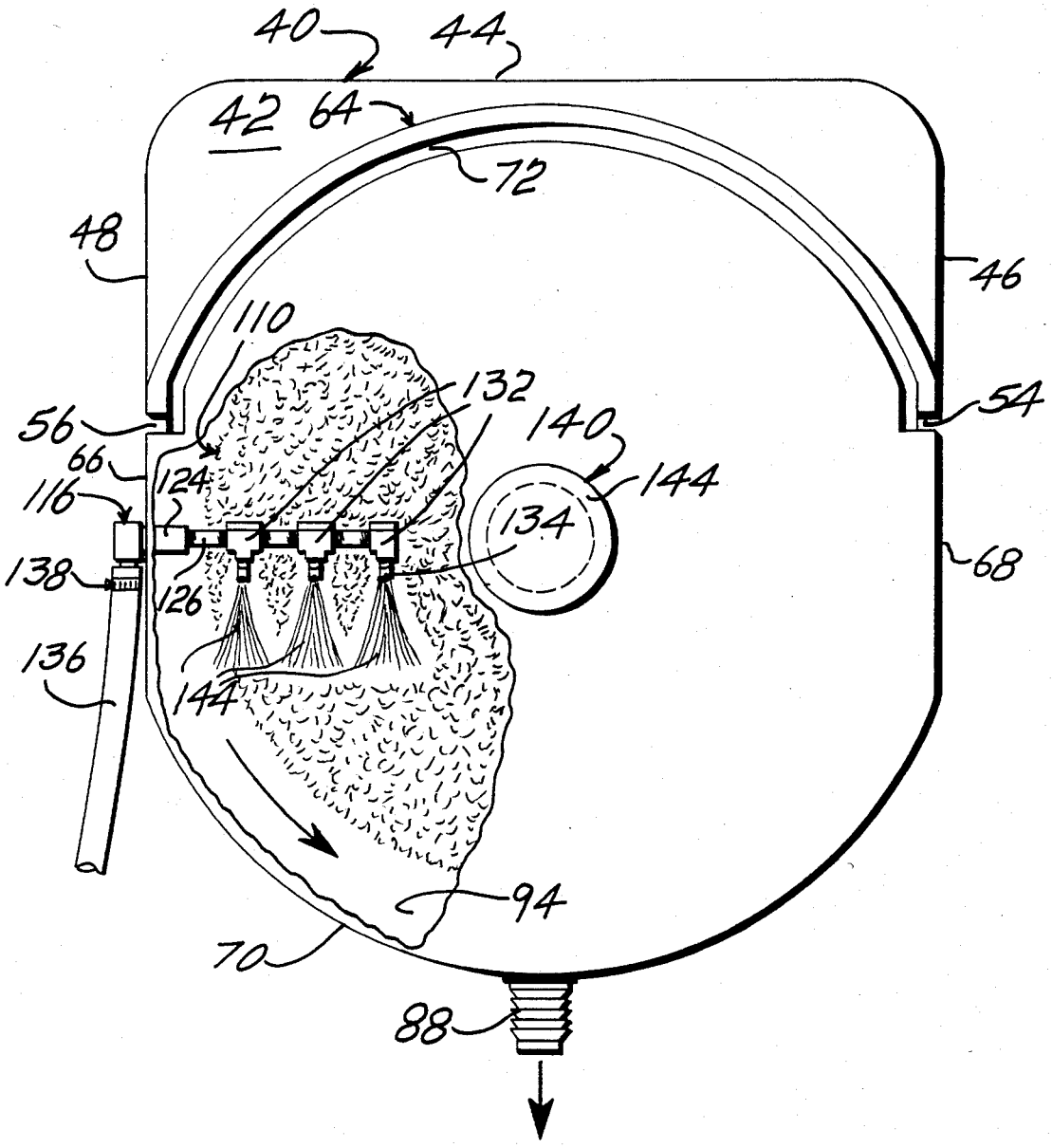
FIG. 18 is a front elevational view of the washer, with the front panel partially broken away, with the shaft in position in the passageway in the front panel, with the washer or mat mounted on the shaft, and with the nozzles directing a liquid onto the mat or member.
Figure 19:
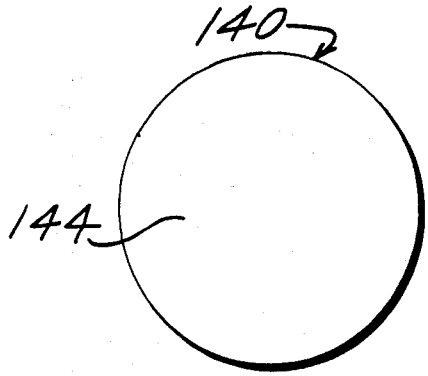
FIG. 19 is an outside elevational view of the shaft.
Figure 20:
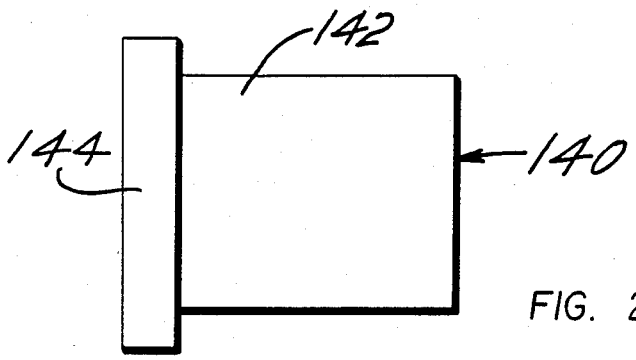
FIG. 20 is a side elevational view of the shaft.

In FIG. 18 it is seen that the arbor or shaft 140 is positioned in the passageway 74 in the front panel 62. The right circular cylinder 142 is passing through the circular passageway 112 of the circular mat 110. The end of the right circular cylinder 142 is positioned in the circular recess 58 in the back panel 42.

The nozzles 134 are directed inwardly and downwardly and spray a liquid onto the fibrous mat 110. The force of the liquid spray on the fibrous mat causes the fibrous mat to rotate in a counter-clockwise direction around the arbor or shaft 140. Naturally, the external diameter of the right circular cylinder 142 should be less than the internal diameter of the passageway 112 in the circular mat 110. The spray 144 from the nozzles 134 hits the mat and causes the mat to rotate. The liquid after hitting the mat drains through the threaded nipple 88 in the bottom of the washer 40. With the rotation of the mat 110 it is seen that there is continually presented to the spray 144 another surface. In time, the spray 144 will contact the surface of the mat 110 a number of times and dislodge particles of dirt, paint, wax, plastic and the like so as to clean the mat.

In FIG. 18 it is seen that a hose 136 connects with the plumbers ELL 116. A clamp 138 may be around the hose 136 to firmly attach the hose to the plumbers ELL 116.

In FIG. 24 there is a schematic illustration of a unit which can be used for cleaning a mat 110. There is a washer 40 having the discharge unit nipple 88 at the bottom. There are the spaced apart nozzles 134 which by means 130 connect with control valves 150. The control valves by suitable piping connect with the TEE 124. The TEE 124 connects with a pipe 136. The pipe 136 also connects with a pipe 152. In the pipe 152 there is a venturi 154. There is a source of water 156 which connects with the pipe 152. The water 156 goes through the pipe 152 and through the venturi 154.

There is source of cleaning agent 158 which connects with the pipe 136 by means of pipe 160. It is seen that the pipe 160 connects with the pipe 136 downstream from the venturi 154. The cleaning agent may be one of many cleaning agents such as a detergent, soap, alcohol, acetone, or the like.

Underneath the discharge nozzle 88 there is a discharge sink 162.

The source of water can be cold water or it can be hot water in the range of 140° F. to 180° F. It is conceivable that the water 156 can be warmer than 180° F. The source of water 156 can be a hot water tap. The discharge sink 162 can be a sink. In fact, the washer 140 can be positioned above the discharge sink 162 so that the flow of water and cleaning agent through the nozzle 88 can go into the discharge sink 162 and from there into the sewer system. It may be desirable to not use any cleaning agent 158 but only hot water 156. From experience, I have noticed that in most applications that hot water 156 is sufficient to clean the mat 110. In fact, I can direct hot water from the tap and which hot water may be in the range of 140° to 180° F. The hot water upon contacting the mat causes the mat to rotate and the particles of impurity in the mat or pad are dislodged. If a cleaning agent be used then the cleaning agent can be placed in the source of cleaning agent 158 with the hot water flowing through the venturi 154 some of the cleaning agent will flow through the pipe 160 and mix with the water 156. The cleaning agent, again, may be detergent or soap or an alcohol or the like. The cleaning agent 158 will mix with the water in the pipes 136. It may be desirable to direct water and/or water and cleaning agent to both sides of the mat, or to only one side of the mat or pad. The flow of water and/or water and cleaning agent is controlled by the valves 150. Again, the liquid leaving the washer 140 can be discharged into a sink 162 and from there into the sewer system.

In FIG. 25 there is illustrated a modification of the system. FIG. 25 is a schematic system illustrating a washer, nozzles 134, pipes 130, valves 150, TEE 124 and pipe 136. There is the discharge nozzle 88 from the washer 40. A pump 170 connects with the pipe 136 and also connects with the pipe 172. There is a cleaning solution 174 which may be an alcohol such as isopropyl alcohol, ethyl alcohol, methyl alcohol, to name a few. Also, the cleaning agent may be a ketone such as acetone and the like. It is conceivable that the cleaning agent can be carbon tetrachloride or perchloroethylene. A pipe 176 connects with the pump 170. On the pipe 176 there is a valve 180. The pipe 176 also connects with a reservoir 182. The reservoir 182 connects with a pipe 184 which connects with the valve 186. The valve 186 connects with the discharge pipe or discharge nozzle 88 and also connects with the discharge pipe 188. The pump can force the rinse solution 174 through one or both nozzles 134 depending upon the valve openings 150. The solution 174 upon striking a mat or pad 110 causes same to rotate to expose a new surface to the solution 174. The solution 174 upon leaving the washer 40 can flow through the pipe 88, the valve 186, the pipe 184 into the reservoir 182. After the rinse solution 174 has been used the recylced rinse solution in the reservoir 182 can flow through the pipe 176 and the valve 180 and can be forced by the pump through the pipe 136 and through the nozzles 134 to once again contact the mat or pad. The impurities in the mat or pad can be removed by the solution 174 which may dissolve some of the impurities so as to assist in removing them. Another manner of operation is to take the old solution or recycled solution 174 in the reservoir 182 and flow it through the pipe 176 and the valve 180 by means of the pump 170 and through the nozzles 134 to remove the first majority of the contaminants in the mat or pad 110. Then, after the recycled solution 174 has removed most of the contaminants from the mat or pad 110 it is possible to set the valve 186 so as to discharge through the pipe 188. Then, fresh solution 174 can be used for removing the rest of the particles and impurities from the mat 110.

With respect to FIGS. 24 and 25, the flow of the liquid through the nozzles 134 can be controlled by the valve setting so as to have a small flow or to have a large flow. Also, the flow of the liquid through the nozzles 134 can be set so as to have liquids flow through both of the nozzles or flow through only one of the nozzles.

The stream of cleaning solution upon contacting the mat 110 or the pad 110 causes the mat to rotate or to spin. With the rotation of the mat there is a centrifugal force. The particles or impurities in the mat 110 are subject to this centrifugal force and fly off of the rotating mat. The mat 110 is partially cleaned by centrifugal action.

The materials of construction of the housing for the washer 40 can be a commercially acceptable and available plastic such as polyethylene and polypropalene.

The cover 96 can be a flexible durable plastic, also commercially available, such as polyurethane, an acrylic, such as methacrylate, a cellulose acetate propionate, an ionomer, polyethylene, polypropylene and polyvinylchloride to name a few. The cover 96 may be plastic so that the person can peer into the cavity 94 of the washer 40 to see the progress in the cleaning of the mat.

The plastic should be able to withstand a temperature in the range of 180° F. to 200° F. and also should be resistant to cleaning agents such as alcohol, carbon tetrachloride, perchloroethylene, cleaning agents such as soaps and detergents.

RESUME

The washer 40 comprises a housing having a front panel, a rear panel, side panels and a curved bottom panel. There is a drain means in the bottom to allow spent cleaning solution to drain from the housing. In effect, the housing 40 is a cavity for receiving a pad or mat 110. There is an arbor or shaft 140 on which the pad or mat is mounted. The arbor or shaft is of such a size that it's a squeeze fit with respect to the passageway 74 in the front panel. The outer end of the arbor or shaft 140 fits in the circular recess 58 in the back panel. With the squeeze fit of the arbor or shaft 140 and the passageway 74 no liquid can flow past the arbor or shaft. There is a cover 96 of flexible plastic for mounting over the top portion of the washer 40 so as to prevent the splashing of liquid out of the washer 40. The cover 96 rests on the shoulder 90 or ledge 90 of the back panel and also rests on the shoulder 92 of the front panel. In effect, there is a sealed cavity in which there is positioned the mat or pad.

There are nozzles 134 which are directed downwardly and inwardly for directing a cleaning liquid toward the pad or mat. According to Newton's second law, the liquid flowing from the nozzle 134 strikes the pad and causes the pad to rotate. With the pad rotating there is exposed a fresh surface to the liquid on a continuous basis. A suitable liquid is hot water from a hot water tap in the range of 140° F. to 180° F. The hot water tap will, usually, supply a source of hot water in this temperature range. With the rotation of the pad 110 some of the particles or the impurities fly off.

If necessary, cleaning agents such as a soap or a detergent can be mixed in with the hot water to assist in cleaning the mat or pad.

In exceptional cases, a solvent such as ethyl alcohol, isopropyl alcohol, methyl alcohol, acetone, carbon tetrachloride, perchloroethylene or the like can be used to clean the impurities from the mat or pad or, it is conceivable, that the solvents can be mixed with the hot water to assist in cleaning the mat or pad so as to free the mat or pad from impurities such as wax, dirt, plastic and the like.

It is conceivable that in certain instances that it may be desirable to soak the mat or pad in a cleaning solution such as an aqueous solution of detergent or soap for 12 hours or 24 hours before placing the same in the washer 40 to clean away the particles of impurity. The soaking of the mat or pad in an aqueous solution of a detergent or soap will assist in loosening the particles or impurity.

From experience, we have found that hot water in the range of about 140° F. to 180° F. is usually satisfactory. The mat or pad can be subjected to the hot water for a period of time of three minutes to five minutes and the majority, if not all, of the impurities and particles of dirt are removed. However, it is conceivable that in certain instances the solvents and cleaning solutions may be needed to thoroughly clean the mat.

From the foregoing we consider that one of the advantages is that with this apparatus and method it is possible to clean a mat, inexpensively, in a short period of time in say three to five minutes.

Another advantage is that it is possible to use a mat a number of times such as four or five times. Prior to this invention a mat was used once and then discarded because of the difficulty of cleaning the mat. Some people try to clean a mat by taking a garden hose and a nozzle and directing the water from the nozzle onto the mat. This is not a satisfactory way of cleaning the mat. Therefore, the mat or pad would be discarded after one or two times of use. It is seen that this advantage results in the saving in the cost of a mat as a mat is many times more expensive than subjecting the mat to hot water in the washer 40 for a period of three to five minutes.

In the washer there are no moving parts as such. The mat is rotated according to Newton's second law and depends upon the liquid striking the mat and causing the mat to move to expose a new surface continuously to the liquid.

We consider the apparatus to be inexpensive. The apparatus is made of plastic and can be formed to the desired configuration. The nozzles are made of metal such as brass to resist deterioration and for long life, but the washer itself comprising the front and rear panels, sides and bottom, and the tough plastic flexible cover are made of plastic. The threaded pipe 122 is positioned in the passageway 192 in the side of the housing of the washer 40. The plumber's ELL 116 is on the outside of the washer 40 or the outside of the side of the washer 40 and the TEE 124 is in the inside of the washer 40 or in the cavity of the washer 40. To repeat, the threaded pipe 122 is in the passage 192 in the side edge 66 of the washer 40. The threaded pipe 122 will normally be of metal although it is conceivable that this threaded pipe 122 can be of plastic.

Another advantage of this apparatus is that there is substantially no maintenance of the apparatus. The apparatus is, essentially, maintenance free.

In preparing this patent application we did not make a patent search.

We consider this invention to be new and unobvious. We make a living by manufacturing and selling industrial cleaning apparatus. We have never seen an apparatus similar to this apparatus and do not know of an apparatus for cleaning mats other than a garden hose and a nozzle. With a garden hose and a nozzle the people lay the mat on the ground and direct the water from the nozzle onto the mat. In our opinion this is not a satisfactory way of cleaning a mat. As a result of the unsatisfactory method of cleaning the mat the mat is often discarded. We consider the invention to be unobvious as we have never seen a similar apparatus.

The invention is useful as it can be used to clean mats and with the cleaning of the mats it is possible to use a mat maybe four of five times instead of one time. Prior to this invention a mat was used one time and discarded. With this invention it is less expensive to clean the mat and use it four of five times than it is to use the mat one time and throw away the mat.

In effect, the invention is for an apparatus and a method for separating a mat or member and particles, viz., impurities, from each other to leave a used clean mat or member. The particles or impurities are discarded. The mat or member is, essentially, two dimensional or coplanar as it has an external dimension many times greater than its thickness. A fluid may strike one surface or both surfaces of the mat, either one surface at a time or both surfaces simultaneously. The mat is mounted on a support or a shaft and is free to rotate. The fluid is directed towards the mat and the mat is forced to rotate to expose a rotating surface to said fluid. In effect the rotating mat is continually exposing a fresh material, i.e., the rotating surface, to the fluid. The fluid upon hitting the mat and the particles separates the particles from the mat to form a used cleaned mat or a used cleaned member.

From the foregoing and having presented my invention, what we claim is:

1. A method for removing particles from a fibrous mat, said method comprising:

a. positioning said fibrous mat on a support;

b. said fibrous mat being, substantially, coplanar while positioned on the support and having an external dimension many times greater than the thickness of said fibrous mat;

c. said fibrous mat having a first surface and a second surface on a side of the mat opposite said first surface;

d. directing an aqueous medium to said fibrous mat to contact said first surface and to contact said second surface to remove said particles from said fibrous mat and to rotate said fibrous mat while positioned on the support at a speed sufficient to cause said particles to leave said fibrous mat due to centrifugal force.

2. A method according to claim 1 and comprising:

a. said support being a shaft; and, b. said fibrous mat being positioned on said shaft.

3. A method according to claim 2 and comprising:

a. said fibrous mat being of a circular configuration and having a central passageway; and, b. said shaft being in said central passageway.

4. A method according to claim 1 and comprising:

a. prior to directing said aqueous medium to said fibrous mat processing said fibrous mat by pre-cleaning said fibrous mat to make it possible to more readily remove said particles from said fibrous mat.

5. A method according to claim 3 and comprising:

a. prior to directing said aqueous medium to said fibrous mat processing said fibrous mat by pre-cleaning said fibrous mat to make it possible to more readily remove said particles from said fibrous mat.

6. A method according to claim 1 and comprising:

a. said aqueous medium comprising a cleaning agent.

7. A method according to claim 3 and comprising:

a. said aqueous medium comprising a cleaning agent.

* * * * *